US011097335B2

(12) United States Patent
Wang et al.

(10) Patent No.: US 11,097,335 B2
(45) Date of Patent: Aug. 24, 2021

(54) OPENING-AND-CLOSING TYPE HEATER AND WIND GENERATOR SHAFT FORGING PROCESS USING THE SAME

(71) Applicant: Jiangyin Zenkung Forging Co., Ltd., Jiangsu (CN)

(72) Inventors: Feibo Wang, Jiangsu (CN); Jiandong Xu, Jiangsu (CN); Shengxiang Liu, Anhui (CN); Zhenhua Qi, Jiangsu (CN); Chunlei Xu, Jiangsu (CN); Yue Huang, Jiangsu (CN)

(73) Assignee: Jiangyin Zenkung Forging Co., Ltd., Wuxi (CN)

( * ) Notice: Subject to any disclaimer, the term of this patent is extended or adjusted under 35 U.S.C. 154(b) by 613 days.

(21) Appl. No.: 15/865,231

(22) Filed: Jan. 8, 2018

(65) Prior Publication Data

US 2018/0345355 A1 Dec. 6, 2018

(30) Foreign Application Priority Data

Jun. 5, 2017 (CN) ..... 201710413137.3

(51) Int. Cl.

| | |
|---|---|
| ***C21D 9/08*** | (2006.01) |
| ***F03D 80/00*** | (2016.01) |
| ***F27B 7/34*** | (2006.01) |
| ***B21J 17/00*** | (2006.01) |
| ***B21K 1/06*** | (2006.01) |
| ***B21J 17/02*** | (2006.01) |

(52) U.S. Cl.

CPC ..... *B21J 17/00* (2013.01); *B21J 17/02* (2013.01); *B21K 1/06* (2013.01)

(58) Field of Classification Search

CPC .. F27B 7/08; F27B 7/34; F27D 1/0006; F03D 9/00; F03D 80/00; F03D 13/00; B29B 13/024; C21D 9/08; C21D 8/10; B21J 17/00; B21K 1/06

See application file for complete search history.

(56) References Cited

U.S. PATENT DOCUMENTS 2,131,665 A * 9/1938 Jordan ..... F27B 7/08 432/61
4,039,279 A * 8/1977 Horeczko ..... B29B 13/024 432/225
4,882,468 A * 11/1989 Bouchon ..... C21D 1/773 219/400

(Continued)

*Primary Examiner* — Gregory A Wilson

(57) ABSTRACT

A heating/heat-retaining device, particularly to a heating/heat-retaining device used in the forging process, and more particularly to an opening-and-closing type heater and a wind generator shaft forging process using the same. The opening-and-closing type heater comprises a base, a tube body mounted on the base and a tube body opening-and-closing mechanism; the tube body comprises a fixed tube body and a movable tube body, the fixed tube body and the movable tube body are arc-shaped shells, and form a hollow shape when the openings thereof match with each other; the tube body opening-and-closing mechanism is connected to the movable tube body for realizing the opening-and-closing of the movable tube body and the fixed tube body. The invention solves heat retaining and heating problems during the forging process of the main shaft forgings and avoids internal defects due to rapid temperature drop of the main shaft forgings.

8 Claims, 3 Drawing Sheets

(56) References Cited

U.S. PATENT DOCUMENTS

| | | | | | |
|---|---|---|---|---|---|
| 4,986,750 | A * | 1/1991 | Sakamoto | F27B 9/38 | 432/131 |
| 5,414,927 | A * | 5/1995 | Fiel | C04B 35/52 | 29/611 |
| 5,434,387 | A * | 7/1995 | Haley | B29B 13/024 | 219/535 |
| 5,853,289 | A * | 12/1998 | Todd | B29B 13/024 | 432/225 |
| 5,926,933 | A * | 7/1999 | Kaehr | F23G 1/00 | 110/336 |
| 7,133,606 | B1 * | 11/2006 | Elliott | B29B 13/024 | 392/411 |
| 10,316,384 | B2 * | 6/2019 | Qi | B21J 5/08 | |
| 2016/0047360 | A1 * | 2/2016 | Fex, Jr. | F24F 7/04 | 415/1 |
| 2019/0137181 | A1 * | 5/2019 | Zhdanok | F27B 7/224 | |

* cited by examiner

OPENING-AND-CLOSING TYPE HEATER AND WIND GENERATOR SHAFT FORGING PROCESS USING THE SAME

CROSS-REFERENCE TO RELATED APPLICATIONS

The present application claims the benefit of Chinese Patent Application No. 201710413137.3 filed on Jun. 5, 2017, the contents of which are hereby incorporated by reference.

TECHNICAL FIELD

The invention relates to a heating/heat-retaining device, particularly to a heating/heat-retaining device used in the forging process, and more particularly to an opening-and-closing type heater and a wind generator shaft forging process using the same.

BACKGROUND

Large shaft parts, such as the main shafts of wind generators, are often forged to improve their mechanical properties. Forgings of such main shafts are generally formed by free forging on a large forging press. Due to large size and heavy weight, the parts are usually repeatedly heated in a heating furnace and forged on a forging press to form the final forged products. In the forging process of the main shaft forgings, temperature decreases gradually due to heat transfer in air. When temperature is lowered to certain value, it is difficult to forge the parts and the inside of the forgings will produce stress due to rapid temperature drop in the forging process, which may cause cracks and bring quality problem of forgings.

The forging of the main shaft forgings involves multiple processes, such as clamping forging and pressing, upsetting, stretching and rounding, in which the stretching process takes much time because the main shaft is long. In the stretching process, the main shaft forgings are clamped by the manipulator and forged piecewise on the anvil of the manipulator by its rotation and axial feeding. As the forging process takes a long time, temperature drop is large.

In the prior art, in order to avoid internal defects of the forgings under the temperature stress, when temperature of the forgings is lower than the limit value, the forging process is stopped to heat the forgings in the heating furnace, resulting in an increase of firing number and of energy consumption due to increased forging period. Or, in order to avoid repeated heating, the forging process must be completed within the specified time, which always causes poor roundness, large machining allowance and other defects of the workblank of the main shaft forgings. Therefore, in the prior art, the forging process of the main shaft forgings does not have sufficient time for fine forging due to the temperature limit, and causes generally large allowance of the forgings and poor dimensional accuracy.

SUMMARY OF THE INVENTION

In order to solve the above technical problems, avoid internal defects of the main shaft forgings, realize fine forging of large main shaft forgings and improve quality of the forgings in an all-round way, the invention proposes an opening-and-closing type heater for heat retaining or heating during the forging process of the main shaft, and a wind generator shaft forging process using the heater. The technical solutions are as follows:

An opening-and-closing type heater comprises a base, a tube body mounted on the base and a tube body opening-and-closing mechanism; the tube body comprises a fixed tube body and a movable tube body, the fixed tube body and the movable tube body are the arc-shaped shells and the openings thereof form a hollow shape when matched with each other; the tube body opening-and-closing mechanism is connected to the movable tube body for realizing the opening-and-closing of the movable tube body and the fixed tube body.

Usually, a refractory fireproof material layer is arranged on the inner wall of the fixed tube body and the movable tube body.

In order to achieve the heating of the main shaft forgings, a heating device is arranged on the tube body for heating the inside of the tube body. The heating device may be an infrared heater or an electric heater, and preferably a gas heater. Specifically, the tube body is provided with a gas fire pipe injector and the nozzle thereof is provided with an igniter.

In order to measure surface temperature of the main shaft forgings in real time and judge the necessity of heating, the tube body may be provided with a measuring element for measuring temperature of internal forgings thereof.

In the invention, the movable tube body and the fixed tube body are rotatably connected by a pin, the tube body opening-and-closing mechanism is a linear actuator (e.g. cylinder and electric push rod), the actuator body and the base are rotatably connected by a pin, the extension head of the linear actuator and the movable tube body are rotatably connected by a pin.

Preferably, the temperature measuring element can be an infrared thermometer.

In order to heat the section of the main shaft forgings between a forging manipulator and an anvil, and to avoid interference by the opening-and-closing type heater and the forging manipulator, a heater moving mechanism is further arranged to move the opening-and-closing type heater in a direction perpendicular to the opening-and-closing centerline of the opening-and-closing type heater, of which the base is mounted on the moving mechanism.

Specifically, the moving mechanism comprises a fixing seat, a telescopic seat, a guide rod, a driving screw and a driving motor, the base is mounted on the telescopic seat with a shaft being mounted in the hole of the fixing seat and slidably fit with the hole, the driving motor is mounted on the fixing seat, and the shaft of the driving motor is connected to the transmission screw rod in screwed connection with the telescopic seat, one end of the guide rod is fixed to the telescopic seat, and the other end slidably passes through the hole of the fixing seat, wherein, the driving motor can be a servo motor to control the moving position.

In addition, taking into account that the opening-and-closing type heater is installed on a worktable of a forging press, in order not to affect the forging equipment due to overtemperature of the base of the opening-and-closing type heater, a cooling chamber is arranged on the base of the opening-and-closing type heater for accommodating cooling circulating water, and the cooling chamber is provided with water inlet and outlet.

The wind generator shaft forging process using the opening-and-closing type heater adopts one of the following methods during the forging process of the wind generator shaft:

Method 1: place an opening-and-closing type heater on a worktable of a forging press, and keep the opening-and-closing center of the opening-and-closing type heater on the same axis of a wind generator shaft forging; and start the heater to heat the wind generator shaft forging when it is necessary to heat the wind generator shaft forging;

Method 2: arrange an opening-and-closing type heater with a moving mechanism on one side of a wind generator shaft forging between a clamping head for clamping the wind generator shaft forging on a forging manipulator and an anvil of the forging press; when it is necessary to heat the wind generator shaft forging, send the opening-and-closing type heater to the center of the wind generator shaft forging by the moving mechanism and start the heater for heating the wind generator shaft forging.

In addition, if the main shaft is too long, multiple sets of opening-and-closing type heaters may be arranged in parallel to achieve full length heating of the main shaft forgings except the place at the anvil during the forging process.

The beneficial effects of the invention are as follows:

Firstly, the invention solves heat retaining and heating problems during the forging process of the main shaft forgings and avoids internal defects of the main shaft forgings caused by temperature drop, so as to improve their mechanical performance and effectively ensure their strength.

Secondly, the invention can effectively avoid the drawback that the forgings are reheated due to temperature drop during the forging process, effectively reduce the firing number of the forgings, simplify the forging process, increase the forging efficiency and save the energy consumed.

Thirdly, the invention can allow sufficient forging of the main shaft forgings, giving enough time for forging under the condition that the forgings are reheated in the furnace, so as to realize fine forging of the main shaft forgings, effectively reduce their machining allowance and increase their dimensional accuracy.

Fourthly, the opening-and-closing type heater is provided with an infrared temperature measuring element so that the main shaft forgings can be heated and controlled according to its actual temperature, so as to keep the forging temperature in a more reasonable range and obtain a forging with better quality compared with the wide forging temperature range in the prior art.

Figure 1:
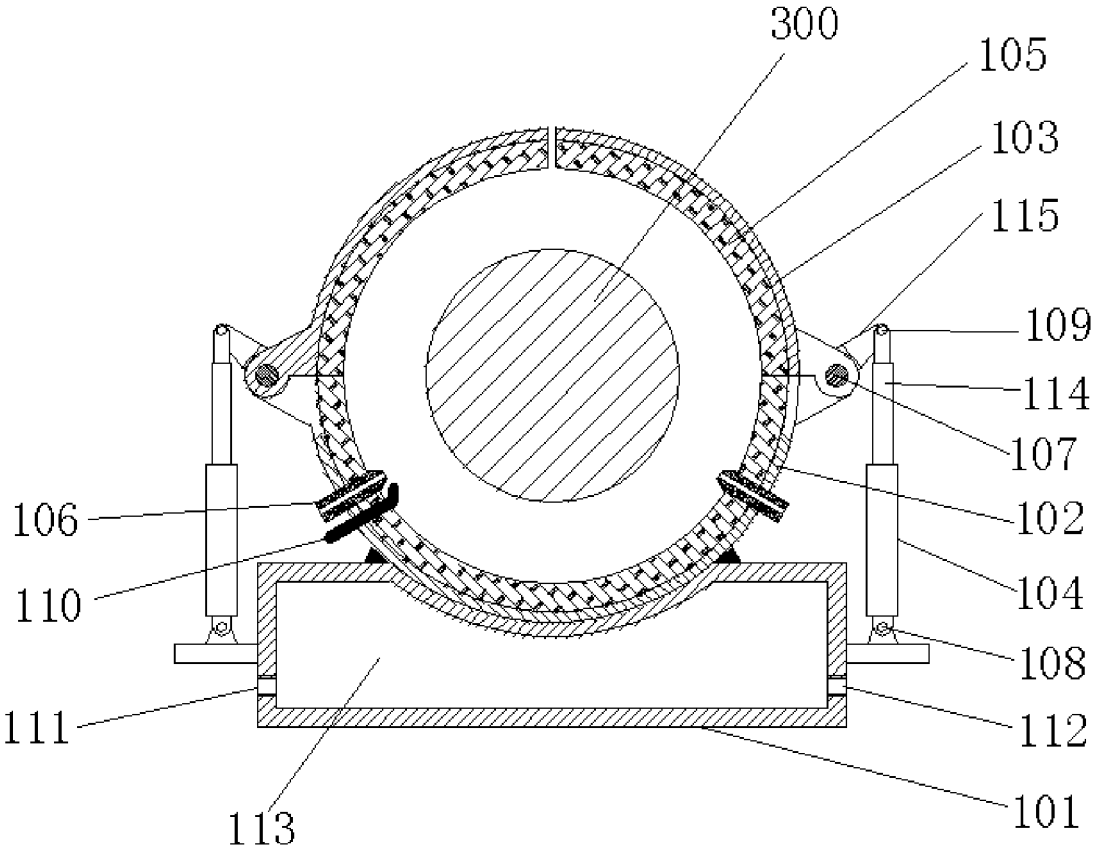
FIG. 1 is a structural schematic diagram of the opening-and-closing type heater.
Figure 2:
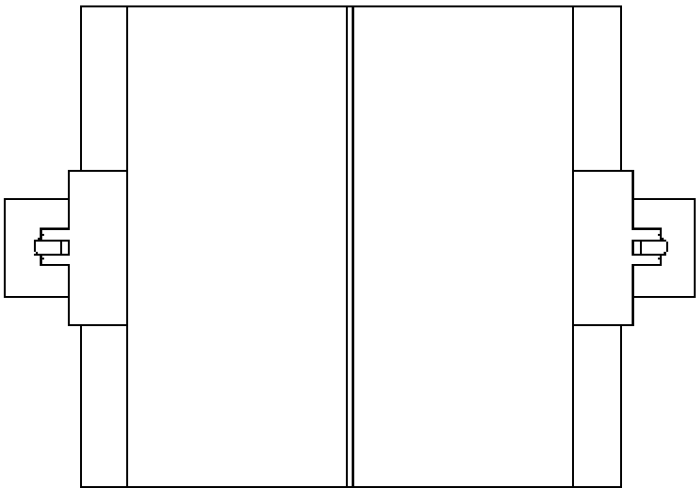
FIG. 2 is a top view of FIG. 1.
Figure 3:
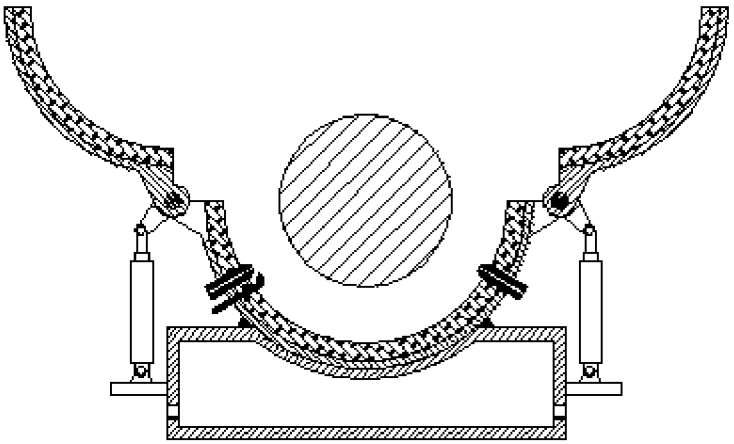
FIG. 3 is a schematic diagram of the opening-and-closing type heater in FIG. 1 with the movable tube body being opened.

In the figure, 100: opening-and-closing type heater; 101: base; 102: fixed tube body; 103: movable tube body; 104: opening-and-closing mechanism (cylinder); 105: refractory fireproof material layer; 106: heating device (gas fire pipe injector); 107: pin I; 108: pin II; 109: pin III; 110: igniter; 111: water inlet; 112: water outlet; 113 cooling chamber; 114: telescopic head of linear actuator; 115: the opening-and-closing handle on movable tube body;

In the figure, 200: heater moving mechanism; 201: fixing seat; 202: telescopic seat; 203: shaft on telescopic seat; 204: guide rod; 205: transmission screw rod; 206: driving motor;

In the figure, 300: wind generator shaft;

In the figure, 400: forging press; 401: worktable of forging press; 402: anvil;

In the figure, 500: forging manipulator; 501: clamping head on forging manipulator.

DETAILED DESCRIPTION OF THE PREFERRED EMBODIMENTS

The invention will be further described in detail in combination with drawings and preferred embodiments. The following embodiments are only used to clearly illustrate the technical solutions of the invention, rather than limit the protection scope of the invention.

EXAMPLE 1

An Opening-and-Closing Type Heater

An opening-and-closing type heater 100 shown in FIG. 1 to FIG. 4 comprises a base 101, a tube body mounted on the base 101 and a tube body opening-and-closing mechanism 104; the tube body comprises a fixed tube body 102 and a movable tube body 103, the fixed tube body 102 and the movable tube body 103 are the arc-shaped shells and the openings of the fixed tube body 102 and the movable tube body 103 form a hollow shape and define two opposite open ends of the tube body when matched with each other; the tube body opening-and-closing mechanism 104 is connected to the movable tube body 103 for realizing the opening-and-closing of the movable tube body 103 and the fixed tube body 102.

A refractory fireproof material layer 105 is arranged on the inner wall of the fixed tube body 102 and the movable tube body 103.

Meanwhile, a heating device 106 is arranged on the tube body for heating the inside of the tube body.

In consideration of real-time temperature measurement of the main shaft forging 300, a temperature measuring element (not shown in the figure) for measuring temperature of the forging in the tube body may be further arranged on the tube body. Preferably, an infrared thermometer is used as the temperature measuring element.

In the opening-and-closing mechanism of the example, the movable tube body 103 and the fixed tube body 102 are connected by a first pin 107, the tube body opening-and-closing mechanism 104 is a linear actuator, and the body of the linear actuator and the base 101 are connected by a second pin 108, and the telescopic head 114 of the linear actuator and the movable tube body 103 are connected by a third pin 109. In the figure, the movable tube body 103 is provided with an opening-and-closing handle 115, and the telescopic head 114 of the linear actuator is connected with the movable tube body 103 through the opening-and-closing handle 115 on the movable tube body, wherein, the linear actuator is the cylinder or electric push rod. In application, the telescopic head 114 on the linear actuator is controlled to move forward or backward, drives the movable tube body 103 and rotates the movable tube body 103 around the pin 109, so as to realize the opening-and-closing of the movable tube body 103.

In the example, the heating device 106 is preferably a gas fire pipe injector, and an igniter 110 is disposed at the nozzle of the gas fire pipe injector.

Figure 4:
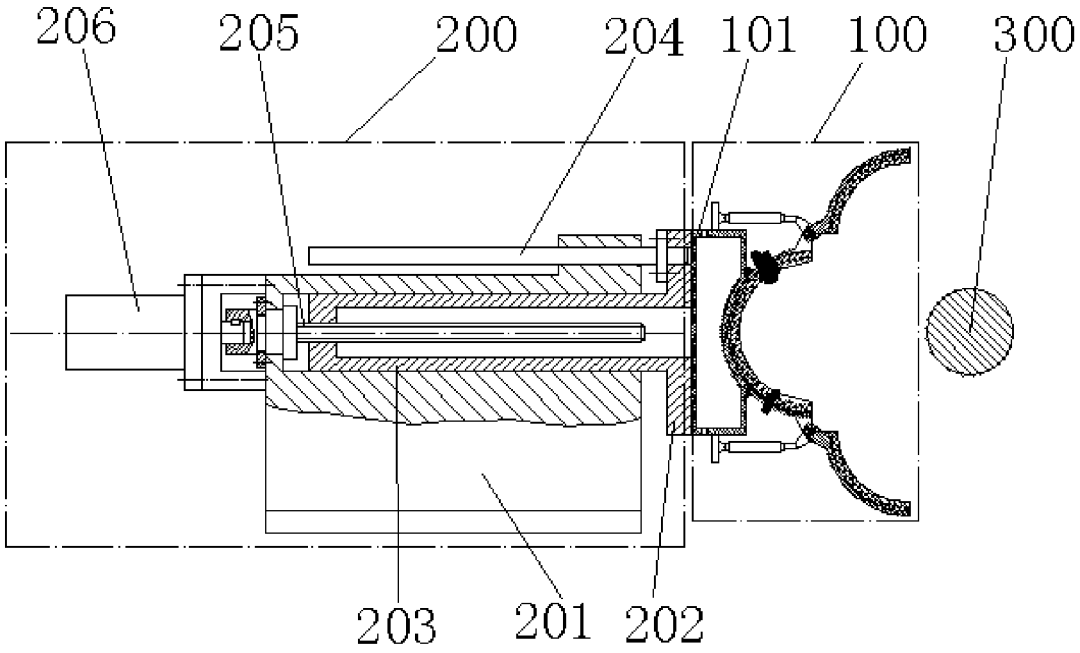
FIG. 4 is a structural schematic diagram of the opening-and-closing type heater with a movable mechanism.

FIG. 4 shows an example, wherein an opening-and-closing type heater 100 is provided with a heater moving mechanism 200 and the base 101 of the opening-and-closing type heater is laterally mounted on the moving mechanism 200.

In the example, the heater moving mechanism can move the opening-and-closing type heater in a direction perpendicular to the opening-and-closing centerline of the opening-and-closing type heater (i.e. the tube body centerline), so as to open the movable tube body of the heater, send the opening-and-closing center of the heater to the position for heating the forgings by the heater moving mechanism, and close the movable tube body for heating when necessary; after the heating is completed, the heater and the moving mechanism will be kept away from the heating position to facilitate the forging operation of the forging press and to avoid interference during forgings handling.

Specifically, the moving mechanism 200 comprises a fixing seat 201, a telescopic seat 202, a guide rod 204, a driving screw 205 and a driving motor 206, the base 101 is mounted on the telescopic seat 202 with a shaft 203 being mounted in the hole of the fixing seat 201 and slidably fit with the hole, the driving motor 206 is mounted on the fixing seat 201, and the shaft of the driving motor 206 is connected to the transmission screw rod 205 in screwed connection with the telescopic seat 202, one end of the guide rod 204 is fixed to the telescopic seat 202, and the other end slidably passes through the hole of the fixing seat 201.

EXAMPLE 2

Figure 5:
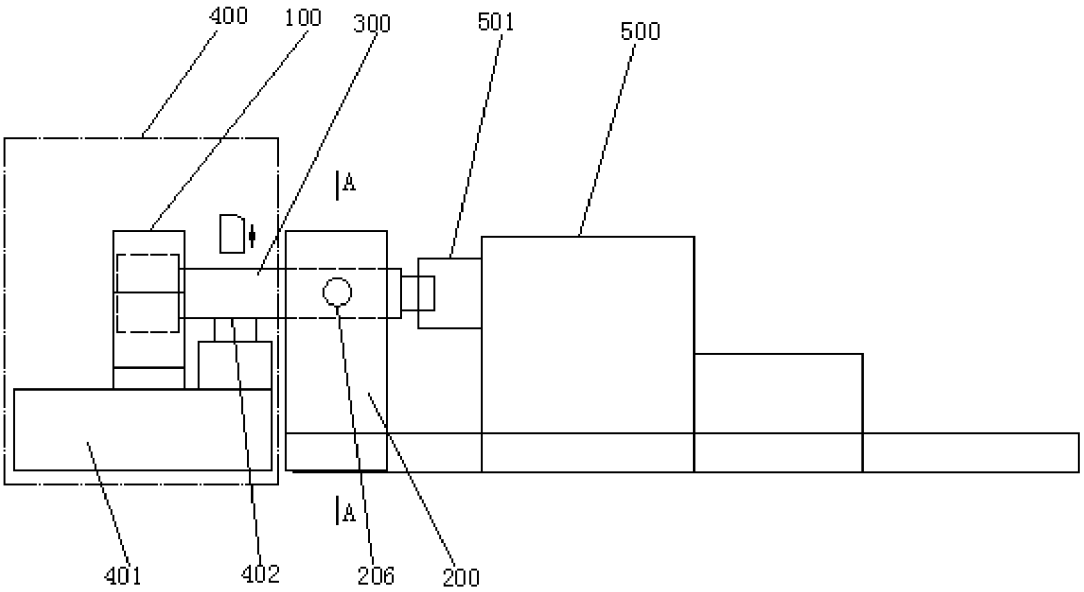
FIG. 5 is a heating diagram of the opening-and-closing type heater in the forging process of the wind generator shaft.
Figure 6:
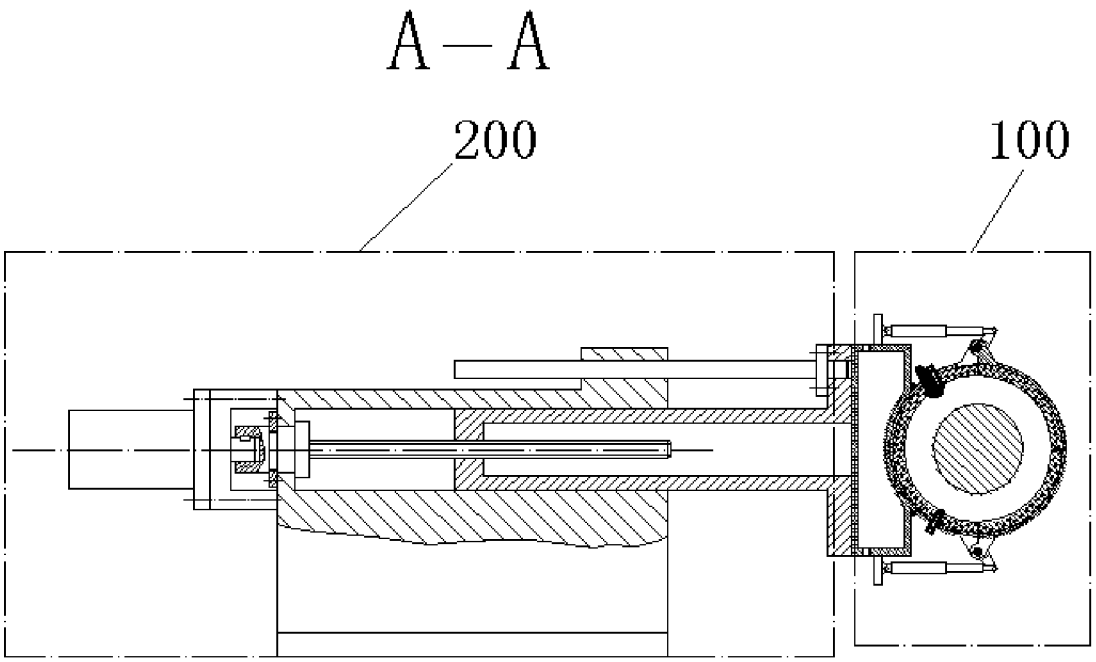
FIG. 6 is an A-A section view of FIG. 5.

Wind Generator Shaft Forging Process Using the Opening-and-Closing Type Heater FIG. 5 to FIG. 6 show an example of the wind generator shaft forgings with the opening-and-closing type heater being used in the stretching process. Specifically, a worktable 401 on a forging press 400 is provided with a fixed opening-and-closing type heater 100 (without a moving mechanism), and an opening-and-closing type heater 100 with a moving mechanism 200 is arranged on one side of the wind generator shaft between a clamping head 501 on the forging press 400 for clamping the wind generator shaft and an anvil 402 of a forging manipulator 500. When necessary, start the heater 106 (ignite the gas fire pipe injector) and heat the wind generator shaft forgings.

The examples are only preferred ones of the invention. It should be noted that those skilled in the art may make various improvements and modifications without departing from technical principles of the invention. These improvements and modifications should also fall within the protection scope of the invention.

The invention claimed is:

1. An opening-and-closing type heater for use in a forging process, comprising a base, a tube body mounted on the base and a tube body opening-and-closing mechanism; wherein, the tube body comprising a fixed tube body and a movable tube body, the fixed tube body and the movable tube body being arc-shaped shells and openings thereof forming a hollow shape and defining two opposite open ends of the tube body when matched with each other; the tube body opening-and-closing mechanism being connected to the movable tube body for realizing the opening-and-closing of the movable tube body and the fixed tube body;

wherein a refractory fireproof material layer is arranged on an inner wall of the fixed tube body and the movable tube body;

wherein the heater further comprises a heater moving mechanism that moves the opening-and-closing type heater in a direction perpendicular to an opening-and-closing centerline of the opening-and-closing type heater, and the base thereof is mounted on the heater moving mechanism;

wherein the heater moving mechanism comprises a fixing seat, a telescopic seat, a guide rod, a driving screw and a driving motor, the base is mounted on the telescopic seat with a shaft being mounted in the hole of the fixing seat and slidably fit with the hole, the driving motor is mounted on the fixing seat, and the shaft of the driving motor is connected to the transmission screw rod in screwed connection with the telescopic seat, one end of the guide rod is fixed to the telescopic seat, and the other end of the guide rod slidably passes through the hole of the fixing seat.

2. The opening-and-closing type heater for use in a forging process according to claim 1, wherein a heating device is arranged on the tube body for heating an inside of the tube body.

3. The opening-and-closing type heater for use in a forging process according to claim 2, wherein the heating device is a gas fire pipe injector and a nozzle thereof is provided with an igniter.

4. The opening-and-closing type heater for use in a forging process according to claim 1, wherein a temperature measuring element is arranged on the tube body for measuring temperature of internal forgings thereof.

5. The opening-and-closing type heater for use in a forging process according to claim 4, wherein the temperature measuring element is an infrared thermometer.

6. The opening-and-closing type heater for use in a forging process according to claim 1, wherein the movable tube body and the fixed tube body are rotatably connected by a first pin, the tube body opening-and-closing mechanism is a linear actuator, the body of the linear actuator and the base are rotatably connected by a second pin, an extension head of the linear actuator and the movable tube body are rotatably connected by a third pin.

7. A wind generator shaft forging process, using an opening-and-closing type heater, the opening-and-closing type heater comprising a base, a tube body mounted on the base and a tube body opening-and-closing mechanism; the tube body comprising a fixed tube body and a movable tube body, the fixed tube body and the movable tube body being arc-shaped shells and openings thereof forming a hollow shape and defining two opposite open ends of the tube body when matched with each other; the tube body opening-and-closing mechanism being connected to the movable tube body for realizing the opening-and-closing of the movable tube body and the fixed tube body; wherein a refractory fireproof material layer is arranged on an inner wall of the fixed tube body and the movable tube body, wherein the wind generator shaft forging process comprises:

placing the opening-and-closing type heater on a worktable of a forging press, and keeping an opening-and-closing center of the opening-and-closing type heater on a same axis of a wind generator shaft forging; and starting the heater to heat the wind generator shaft forging when it is necessary to heat the wind generator shaft forging.

8. A wind generator shaft forging process, using an opening-and-closing type heater, the opening-and-closing type heater comprising a base, a tube body mounted on the base and a tube body opening-and-closing mechanism; the tube body comprising a fixed tube body and a movable tube body, the fixed tube body and the movable tube body being arc-shaped shells and openings thereof forming a hollow shape and defining two opposite open ends of the tube body when matched with each other; the tube body opening-and-closing mechanism being connected to the movable tube body for realizing the opening-and-closing of the movable tube body and the fixed tube body; wherein the heater further comprises a heater moving mechanism that moves the opening-and-closing type heater in a direction perpendicular to an opening-and-closing centerline of the opening-and-closing type heater, and the base thereof is mounted on the heater moving mechanism, wherein the wind generator shaft forging process comprises:

arranging the opening-and-closing type heater with the heater moving mechanism on one side of a wind generator shaft forging between a clamping head for clamping the wind generator shaft forging on a forging manipulator and an anvil of a forging press; when it is necessary to heat the wind generator shaft forging, sending the opening-and-closing type heater to a center of the wind generator shaft forging by the heater moving mechanism and starting the heater to heat the wind generator shaft forging.

* * * * *